United States Patent [19]

Dorner

[11] Patent Number: 4,800,706

[45] Date of Patent: Jan. 31, 1989

[54] APPARATUS FOR LOADING A STACK OF ARTICLES INTO A RELATIVELY FLIMSY CONTAINER

[75] Inventor: Wolfgang C. Dorner, Oconomowoc, Wis.

[73] Assignee: Dorner Mfg. Corp., Hartland, Wis.

[21] Appl. No.: 109,109

[22] Filed: Oct. 16, 1987

[51] Int. Cl.[4] ..... B65B 39/02; B65B 5/06

[52] U.S. Cl. ..... 53/251; 53/245; 53/261; 53/542

[58] Field of Search ..... 53/245, 248, 250, 255, 53/260, 261, 262, 381 R, 384, 457, 458, 459, 492, 535, 542, 251

[56] References Cited

U.S. PATENT DOCUMENTS

| | | | |
|---|---|---|---|
| 2,510,343 | 6/1950 | Krause et al. | 53/381 R |
| 3,001,350 | 9/1961 | Heblij | 53/261 |
| 3,928,942 | 12/1975 | Paddock et al. | 53/261 |
| 3,974,627 | 8/1976 | Groschopp | 53/261 |
| 4,033,090 | 7/1977 | Carlson | 53/245 |
| 4,192,121 | 3/1980 | Caudle | 53/261 |
| 4,487,309 | 12/1984 | Dorner | 198/463.4 |
| 4,570,413 | 2/1986 | Raudat | 53/250 |
| 4,712,355 | 12/1987 | Dorner et al. | 53/260 |

*Primary Examiner*—Robert L. Spruill
*Assistant Examiner*—Beth Tenney
*Attorney, Agent, or Firm*—Andrus, Sceales, Starke & Sawall

[57] ABSTRACT

An apparatus for loading a group of side-by-side stacked articles into a relatively flimsy enlongated open-top container. The containers are conveyed on a conveyor and each container, when positioned beneath a loading unit, is elevated from the conveyor to an elevated position where a pair of parallel spreader plates are received within the container. The spreader plates are pivoted outwardly deflecting the opposite elongated side walls of the container to a generally flat planar condition. With the side walls spread apart, a stack of articles is lowered by the loading unit into the container and the filled container is then lowered back onto the conveyor.

5 Claims, 2 Drawing Sheets

APPARATUS FOR LOADING A STACK OF ARTICLES INTO A RELATIVELY FLIMSY CONTAINER

BACKGROUND OF THE INVENTION

U.S. patent application Ser. No. 20,395, filed Mar. 2, 1987, and now U.S. Pat. No. 4,712,355 describes an apparatus for loading a stack of articles into a container. In accordance with the aforementioned patent application, a stack of articles in side-by-side relation is conveyed along a horizontal conveyor and is deposited in a pivotable bin. A clamping mechanism associated with one of the end walls of the bin clamps the stack to the bin and the bin is pivoted and the bottom wall of the bin is then moved to a release position. The bin containing the clamped stack is then lowered toward a container and by releasing the clamping mechanism, the stack will be dropped into the container.

In some instances, up to fifty articles are stacked in side-by-side relation and loaded into an elongated box or container. Frequently, the container is made of relatively flexible or flimsy material, such as cardboard or plastic, and the elongated side walls of the container tend to bend or deflect, so that they are not parallel. If the elongated side walls of the container are deflected inwardly, then the stack cannot be properly loaded into the container, with the result that the stack is disrupted and articles may jam in the mechanism, resulting in a shutdown of the conveyor system.

SUMMARY OF THE INVENTION

The invention is directed to a method and apparatus for loading a side-by-side stack of articles into an elongated open-top container and has particular application to a mechanism for maintaining the elongated side walls of the container in a parallel relation as the stack is being loaded into the container.

In accordance with the invention, the container to be loaded is supported on a conveyor, which is located beneath a loading unit that clamps the stack in a side-by-side relation.

An elevating mechanism lifts the container upwardly from the conveyor toward the loading unit, and as the container is elevated, a pair of parallel spreader plates are received within the container. The spreader plates, which extend substantially the entire length of the container, are then pivoted outwardly in a direction away from each other to spread the elongated side walls of the container. With the sidewalls spread and in parallel relation, the stack is then loaded by the loading unit into the container. The filled container is then lowered back onto the conveyor and discharged by the conveyor to a storage or working site.

The invention enables a stack, composed of a multiplicity of side-by-side articles, to be loaded into an elongated flexible container. The spreader plates will spread and deflect the flimsy sidewalls to a parallel condition, so that the stack can be deposited in the container without interference from the walls.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
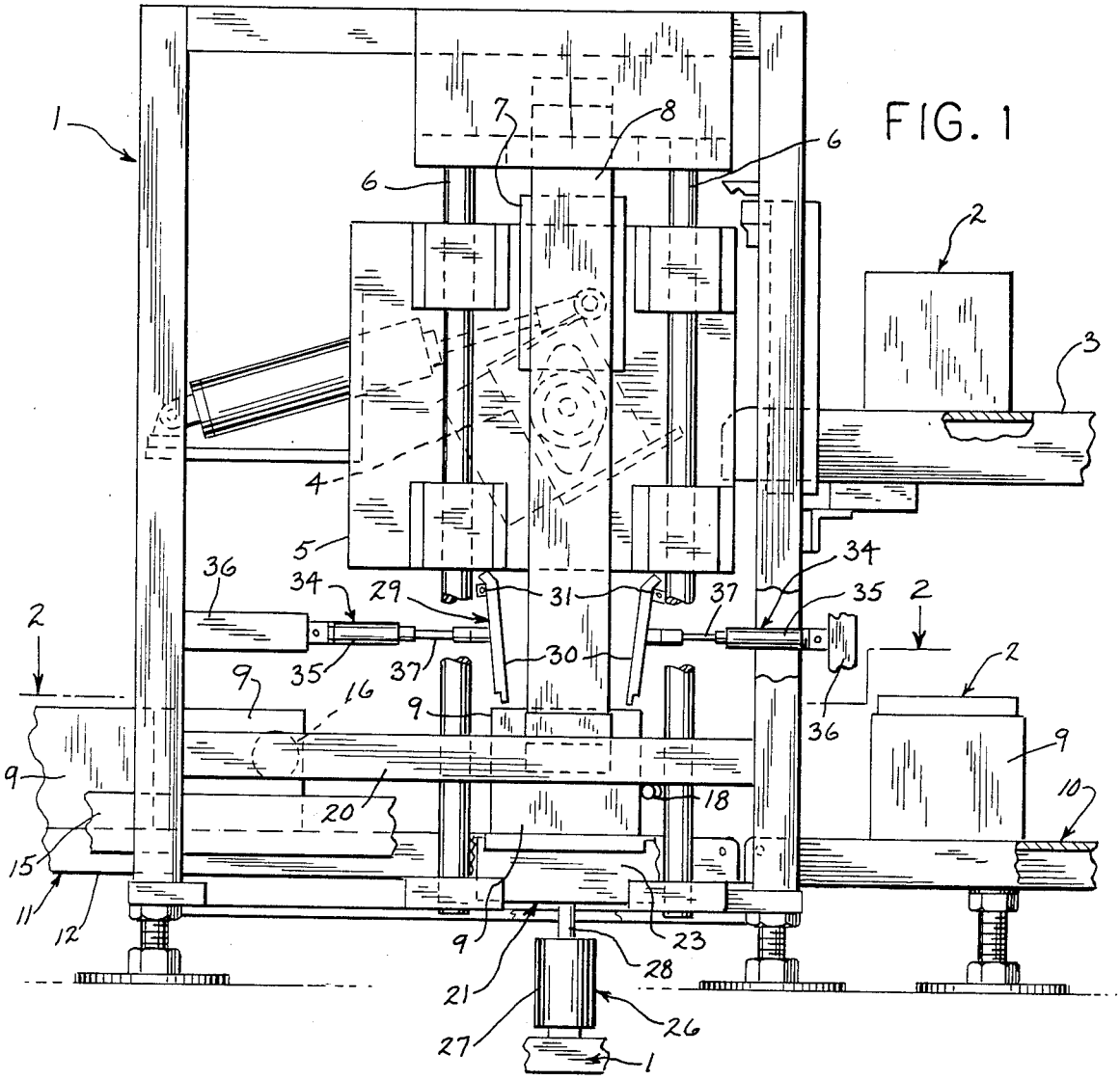
FIG. 1 is a side elevation of the apparatus of the invention.

The invention is an improvement to the apparatus for loading articles as described in U.S. patent application Ser. No. 20,395, filed Mar. 2, 1987, and now Pat. No. 4,712,355 and the structure of the aforementioned patent application is incorporated herein by reference.

In general, the loading unit comprises a generally rectangular frame 1 and stacks 2 of articles that are disposed in side-by-side relation are conveyed to the frame on a conveyor 3 and deposited in a pivotable bin or receiving means 4.

As described in the aforementioned patent application, the bin 4 includes a clamping mechanism which firmly clamps the articles in the stack together. After clamping, the bin 4 is pivoted to a discharge position and in the discharge position, the lower wall of the bin is released, so that the stack 2 can drop from the bin on release of the clamping mechanism.

Bin 4 is carried by a carriage 5, and the carriage is mounted for vertical movement on a series of vertical guide rods 6. To move carriage 5 vertically, the slide 7 of a a rodless fluid cylinder 8 is attached to carriage 5.

With the stack 2 clamped in bin 4, carriage 5 is lowered to position the stack in the upper end of spreader unit 29, and on release of the clamping mechanism, the stack will be deposited in the container. The filled or loaded container 9 is then conveyed away on a conveyor 10.

Stack 2 contains a multiplicity of side-by-side stacked articles and as a consequence, the open top container 9 is elongated. As the container may be formed of relatively thin gauge material, such as cardboard or plastic, the elongated side walls of the container may tend to deform or bend, with the result that the side walls are not parallel, making it difficult to properly load the stack 2 into the container 9.

Figure 2:
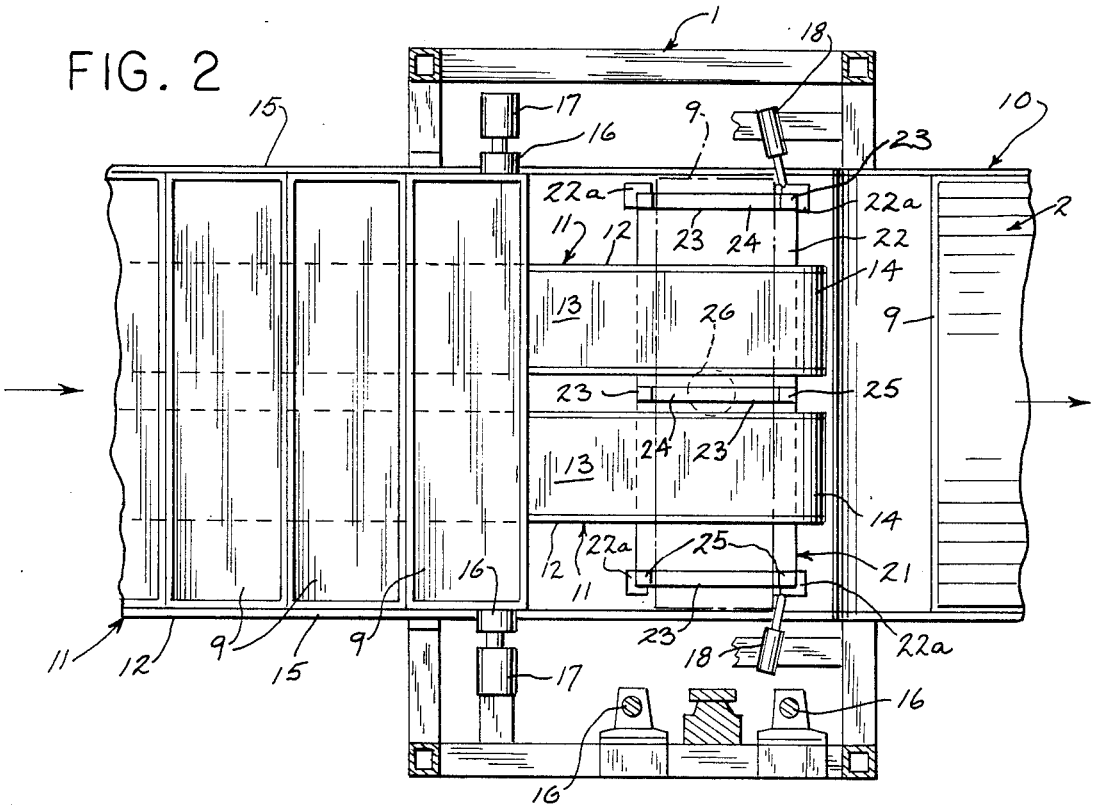
FIG. 2 is a section taken along line 2—2 of FIG. 1.

In accordance with the invention, containers 9 are fed to the loading unit on a pair of spaced parallel conveyors 11. Each conveyor 11 includes a generally U-shaped frame 12, which supports a belt 13 for endless travel. Belt 13 is trained about a drive pulley, not shown, and an idler pulley 14, which is located at the downstream end of the respective conveyor 11. Guide rails 15 are positioned outwardly of the outer side edges of each conveyor 11 and are supported from a frame which supports conveyors 11. Rails 15 serve to guide the containers 9 in movement on the conveyors 11 as they are fed toward the loading unit. As best shown in FIG. 2, the ends of the containers 9 project beyond the outer side edges of the respective conveyors 11.

A row or train of containers 9 is held in a ready position upstream of frame 1 by a pair of squeeze plates 16 which are positioned to engage opposite ends of a container 9, as shown in FIG. 2. Squeeze plates 16 are moved inwardly against the respective ends of the container by fluid cylinders 17, which are mounted on the frame 1. With fluid cylinders 17 extended, container 9 will be held in a ready position on the moving conveyor belts 13 until it is desired to release the container for movement toward the loading unit.

The container 9 to be loaded is held in a loading position on the moving belts 13 by stop assemblies 18, which are mounted on the frame 1. Each stop assembly 18 is supported from frame 1 and can take the form of those described in U.S. Pat. No. 4,487,309. Guide rails 15 guide each container in movement on conveyors 11 from the ready position to the loading position.

Figure 4:
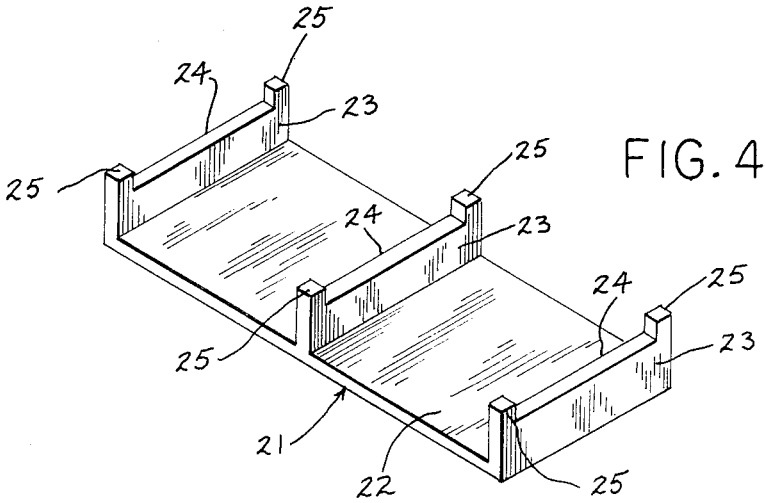
FIG. 4 is a perspective view of the lifting mechanism.

An elevator unit 21 is positioned to elevate the container 9, which is in the loading position, upwardly toward bin 4 in which stack 2 is clamped. As best shown in FIG. 4, the elevator unit 21 includes a generally horizontal plate 22 and three lift members or plates 23 project upwardly in spaced relation from plate 22. As shown in FIG. 2, the central lift member 23 is aligned with the space between conveyors 11, while the outer lift members 23 are located outwardly of the respective conveyors 11. Thus, the lift members 23 can be elevated to a position above conveyor belts 13 without interfering with operation of the conveyors.

As best shown in FIG. 4, each lift member 23 is provided with a generally flat central portion 24, which is adapted to engage the bottom of the container 9 as the elevator unit is raised, and a pair of upstanding end flanges 25 which engage the respective side walls of the container to prevent fore-and-aft displacement of the container as it is elevated.

Figure 3:
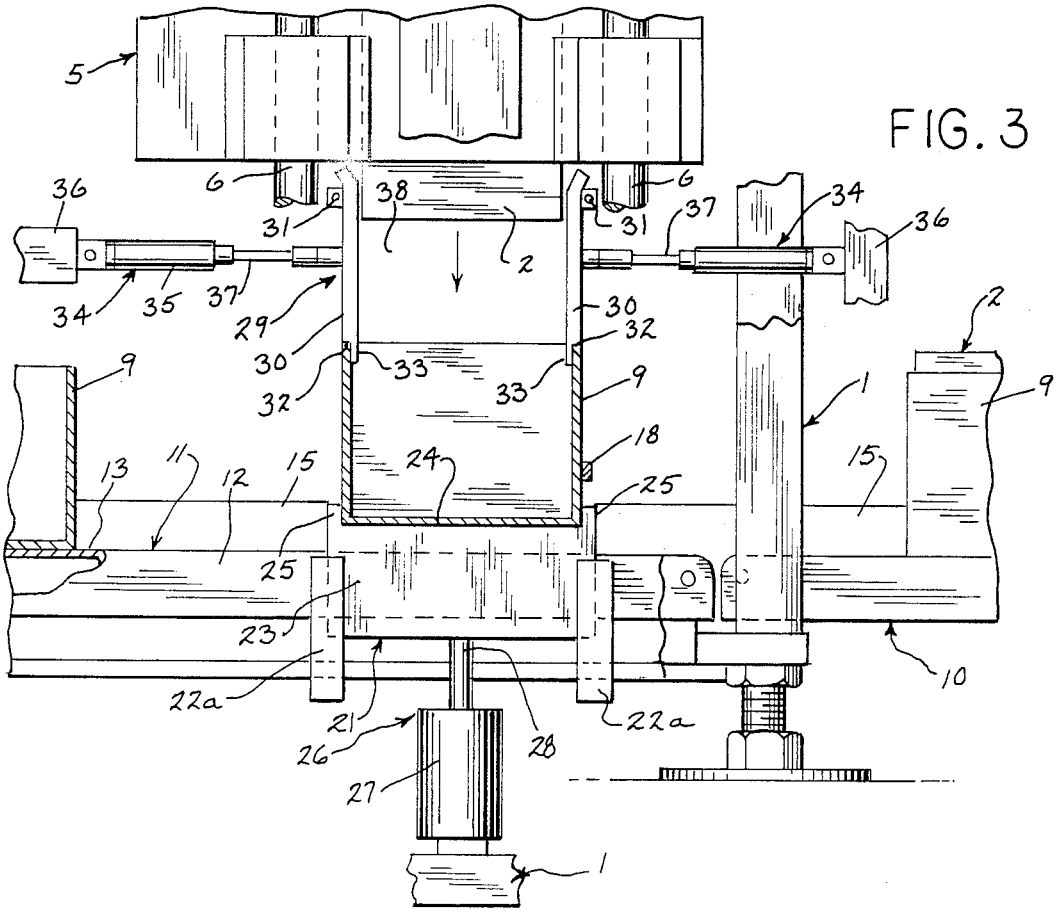
FIG. 3 is a fragmentary vertical section showing the spreader unit.

Lift plate 22 is raised and lowered by a fluid cylinder unit 26, including a cylinder 27 which is connected to the frame 1. A piston rod 28 is movable relative to the cylinder and is connected to the undersurface of plate 22. In the retracted position of cylinder unit 26, lift members 23 will be located beneath the level of belts 13, where they will not interfere with movement of the container 9 on the belts. By extending the piston rod 28 of fluid cylinder 26, lift plate 22 and lift members 23 will move upwardly relative to conveyors 11 to elevate container 9 above the conveyors, as shown in FIG. 3. To guide lift plate 22 in vertical movement, angle-shaped guides **22*a* are located at the corners of the lift plate, as best shown in FIG. 2, and the guides are supported from the frame of conveyors 11**.

As the container 9 is moved upwardly, a spreader unit, indicated generally by 29, acts to spread the elongated side walls of the container. Spreader unit 29 includes a pair of generally parallel spreader plates 30 which extend substantially the entire length of container 9. The upper edge of each plate 30 is connected to a pivot rod 31 which is journalled on frame 1. Spreader plates 30 are adapted to be received within the open upper end of container 9 as it is elevated, and the plates are pivotable from an inner receiving position, as shown in FIG. 1, to an outer spreading position, as shown in FIG. 3.

As best illustrated in FIG. 3, the lower edge of each plate is formed with a shoulder 32, which is located upwardly of the upper edge of the respective side wall of the container, and a lower projecting end 33, which is disposed against the inner surface of the respective side wall.

Each spreader plate 30 is moved between the receiving and spreading position by a fluid cylinder unit 34, each of which includes a cylinder 35 having one end pivotally connected to frame member 36 of frame 1. A piston rod 37 extends outwardly from the opposite end of each cylinder 35 and is pivotally connected to the respective spreader plate 30. Thus, by moving the piston rods 37 from the extended position to the retracted position, the plates 30 will correspondingly be moved from the inner receiving position to the outer spreading position.

In operation, a stack 2 of articles, which are disposed in side-by-side relation, are conveyed on conveyor 3 and fed into the tilted bin 4, which is mounted for pivoting movement on carriage 5. After the stack 2 has been deposited in the bin 4, the stack is clamped to the bin, as described in the aforementioned patent application No. 20,395 and the bin is pivoted and the lower gate or wall of the bin is moved to an open position, so that there is no obstruction to downward movement of the stack from the bin on release of the clamping mechanism.

In the meantime, the container 9 has been released from the ready position by release of squeeze plates 16 and is conveyed on the conveyors 11 to the loading position where it is stopped by the stop assemblies 18. Elevator unit 21 is then actuated to lift the container 9 upwardly and the spreader plates 30 are received within the open upper end of the elevated container. Cylinder units 34 are then operated to move the spreader plates 30 outwardly to position the side walls of the container 9 in a generally parallel straight condition. Carriage 5 is then lowered to position the clamped stack 2 in the space between the spreader plates 30. The stack 2, which is clamped within the bin 4, is then released and the stack will fall by gravity through the space or chute 38, defined by the spaced spreader plates 30 into the container 9.

With the stack 2 deposited in the container 9, the elevator unit 21 is operated to lower the filled container 9 back onto the conveyors 11. Stop assemblies 18 are then released, to permit the filled container to pass from conveyors 11 onto discharge conveyor 10. Spreader plates 30 are then returned to the receiving position in preparation for receiving the next succeeding container 9 to be filled.

The apparatus of the invention provides a mechanism for insuring that an elongated stack of side-by-side articles will be properly deposited in a container, regardless of any deformation which may appear in the elongated sidewalls of the container.

Various modes of carrying out the invention are contemplated as being within the scope of the following claims particularly pointing out and distinctly claiming the subject matter which is regarded as the invention.

I claim:

1. An apparatus for loading an article into an elongated open top container having relatively flexible elongated side walls, comprising conveyor means to convey a container, elevating means for elevating said container to an elevated position above said conveyor means, a pair of spaced spreader members disposed to engage the opposite elongated side walls of a container when said container is in the elevated position, said spreader members being mounted for movement between an inner receiving position and an outer spreading position whereat said spreader members act to spread the side walls outwardly apart, and loading means for loading a stack of side-by-side stacked articles into said container while said side walls are spread apart, said loading means including clamping means for applying clamping pressure to opposite ends of said stack, said loading means also including means for loading the clamped stack into the space between said spreader members when said spreader members are in the outer spreading position, and release means for releasing said clamping means when the lower end of said clamped stack is disposed within said space and above the level of the lower edge of said spreading members whereby said stack will fall by gravity through said space and into said container.

2. The apparatus of claim 1, and including stop means associated with said conveyor means for stopping each stack at a location in alignment beneath said loading means.

3. The apparatus of claim 1, wherein said conveyor means comprises a pair of parallel spaced conveying members, said elevating means being disposed to move within the space between said conveying members.

4. The apparatus of claim 3, wherein the ends of the container project outwardly beyond the side edges of said conveyor means, said elevating means including a pair of end members located outwardly of the respective side edges of said conveyor means for engaging the projecting ends of said container to elevate the same.

5. The apparatus of claim 1, and including means associated with said elevating means for preventing horizontal movement of said container as said spreader plates are removed from the receiving position to the spreading position.

* * * * *